US006741263B1

(12) United States Patent
Pether

(10) Patent No.: US 6,741,263 B1
(45) Date of Patent: May 25, 2004

(54) VIDEO SAMPLING STRUCTURE CONVERSION IN BMME

(75) Inventor: David N. Pether, Wokingham (GB)

(73) Assignee: LSI Logic Corporation, Milpitas, CA (US)

( * ) Notice: Subject to any disclaimer, the term of this patent is extended or adjusted under 35 U.S.C. 154(b) by 273 days.

(21) Appl. No.: 09/960,578

(22) Filed: Sep. 21, 2001

(51) Int. Cl.[7] ..... G09G 5/02
(52) U.S. Cl. ..... 345/600; 345/604; 348/453
(58) Field of Search ..... 345/600, 601, 345/603, 604, 605, 690, 698; 348/441, 445, 446, 450, 453, 663, 665

(56) References Cited

U.S. PATENT DOCUMENTS 5,790,110 A * 8/1998 Baker et al. ..... 345/547
5,844,617 A * 12/1998 Faroudja et al. ..... 348/441
5,900,861 A * 5/1999 Nickerson et al. ..... 345/601
6,097,401 A 8/2000 Owen et al.
6,208,350 B1 * 3/2001 Herrera ..... 345/582
6,326,984 B1 * 12/2001 Chow et al. ..... 345/764
6,614,486 B2 * 9/2003 Hu ..... 348/453
2002/0101536 A1 * 8/2002 Cook et al. ..... 348/453
2002/0111975 A1 * 8/2002 Pether et al. ..... 707/530

* cited by examiner

*Primary Examiner*—Xiao Wu
(74) *Attorney, Agent, or Firm*—Christopher P. Maiorana, P.C.

(57) ABSTRACT

An apparatus comprising a data modification circuit and a composite circuit. The data modification circuit may be configured to generate a first and second video component in response to a video data stream. The composite circuit may be configured to present an output graphics stream by interleaving the first and the second video component.

20 Claims, 5 Drawing Sheets

VIDEO SAMPLING STRUCTURE CONVERSION IN BMME

CROSS-REFERENCE TO RELATED APPLICATIONS

The present application may relate to co-pending application Ser. No. 09/960,572, filed Sep. 21, 2001 and Ser. No. 09/878,594, filed Jun. 11, 2001, which are hereby incorporated by reference in their entirety.

FIELD OF THE INVENTION

The present invention relates to a method and/or architecture for integrating video and graphics processing in a single processor generally and, more particularly, to data modification used to allow changes in sampling structure for video to graphics data conversion.

BACKGROUND OF THE INVENTION

Digital video and/or graphics systems sample and store video in one of a number of formats, each of which include a Y and a C component (the Y component refers to a luminance component of the video and the C component refers to a chrominance component (i.e., a U, V pair)). For convenience with video formats, the Y data is normally stored as a block in one region of memory and the C data (the U, V pairs) is stored as a separate block. For simplicity, the present application will refer to all video and graphics components/samples as 8-bit quantities.

Referring to FIG. 1, a conventional video format 4:2:0 is shown. The video format 4:2:0 has one C sample (i.e., one U, V sample pair) for every group of four Y samples. The effective sample point for the C component is in a center of a square of Y components. In the 4:2:0 format of FIG. 1, an amount of Y component storage required (i.e., 4) is twice that required for the C component (i.e., 2), since each C component comprises a U and a V value.

Referring to FIG. 2, a conventional video format 4:2:2 is shown. The video format 4:2:2 has one U,V sample pair for every pair of Y samples. In the 4:2:2 format of FIG. 2, the C sampling point is coincident with every other Y sample point along a raster line. In the 4:2:2 format, the amount of Y component storage required is identical to that required for the C component.

Referring to FIG. 3, a conventional video format 4:4:4 is shown. The video format 4:4:4 has an identical sample structure for the Y, U and V components. In the 4:4:4 format of FIG. 3, the amount of C component storage required is twice that required for the Y component. The 4:4:4 sampling structure is identical to that used for YUV format graphics data (i.e., 24-bit-per-pixel YUV, or 32-bpp αYUV-8888).

Approaches for conversion between video formats change the number of chrominance samples C relative to the luminance samples Y. In particular, to convert video data to graphics data, the following operations are required, where all conversions use the video format 4:4:4 as a common conversion step (i.e., conversion from 4:2:0, 4:2:2 or 4:4:4 video format to 4:4:4 graphics data):

(i) scaling and filtering operations in both the horizontal and vertical directions are necessary for conversion from 4:2:0 to 4:4:4. Since none of the existing 4:2:0 chrominance C sampling points are aligned with the luminance Y points, it is necessary to interpolate a complete set of C values using either 0.75:0.25 or 0.25:0.75 coefficient pairs for the interpolation;

(ii) scaling and filtering operations in the horizontal direction only is necessary for conversion from 4:2:2 to 4:4:4. All "even" samples along the register line (counting the first sample as sample 0) already have an accurate U,V co-sited sample which can remain unchanged. For "odd" samples a new value must be calculated. The value can be calculated by interpolating horizontally between the neighboring two "even" sample values for U and V; or (iii) interleaving of data is required to combine the separate Y and C data blocks into 24-bpp YUV pixels for conversion from 4:4:4 to graphics YUV. Conversion from 4:4:4 to graphics RGB is similar to conversion to graphics YUV, and followed by a color conversion step to change from YUV to RGB.

It is therefore generally desirable to provide a method and/or architecture capable of video/graphics sampling structure conversion.

SUMMARY OF THE INVENTION

The present invention concerns an apparatus comprising a data modification circuit and a composite circuit. The data modification circuit may be configured to generate a first and second video component in response to a video data stream. The composite circuit may be configured to present an output graphics stream by interleaving the first and the second video component.

The objects, features and advantages of the present invention include providing a method and/or architecture for implementing a video sampling structure conversion engine that may also permit interleaving of Y and C component video data into a single video data stream which may then be easily converted to a graphics data format.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

The implementation of a block move engine (BME) (a bit blitter or blitting engine) for rapidly copying blocks of graphics data from one location in memory to another is generally used for graphics processing. BMEs may be extended to include two input data streams of identical size, which are combined by a logical composition operation and written back to memory as a single data block. The demand for improvements in graphics speed and resolution and the convergence of video and graphics applications onto common platforms has made it desirable to incorporate a wider selection of functions within the general structure of a BME. The present invention may be configured to allow alteration of the sampling structure of video chrominance C components, thus permitting the conversion between video and graphics data formats.

Figure 1:
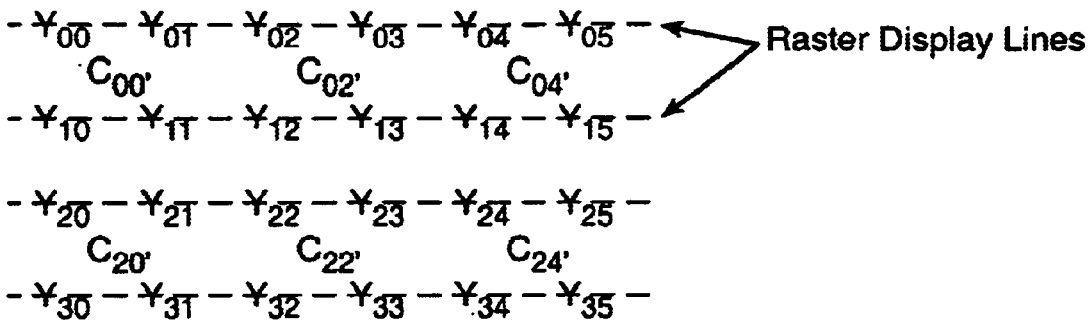
FIG. 1 is a 4:2:0 video sampling structure.
Figure 2:
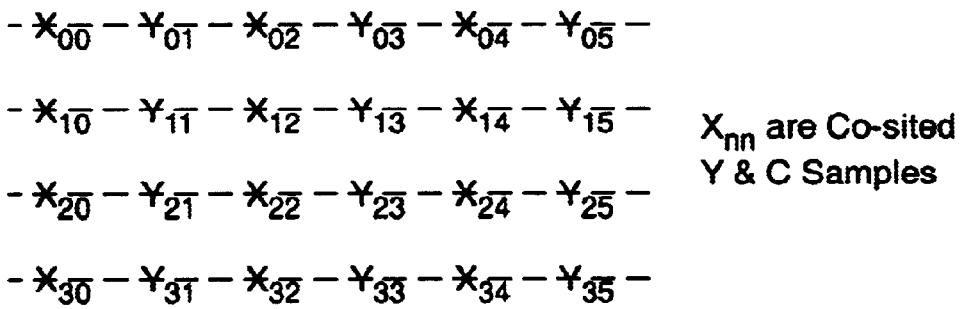
FIG. 2 is a 4:2:2 video sampling structure.
Figure 3:
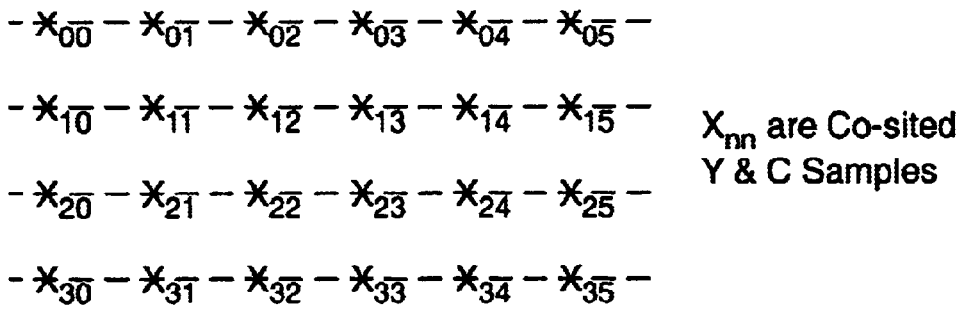
FIG. 3 is a 4:4:4 video sampling structure.
Figure 4:
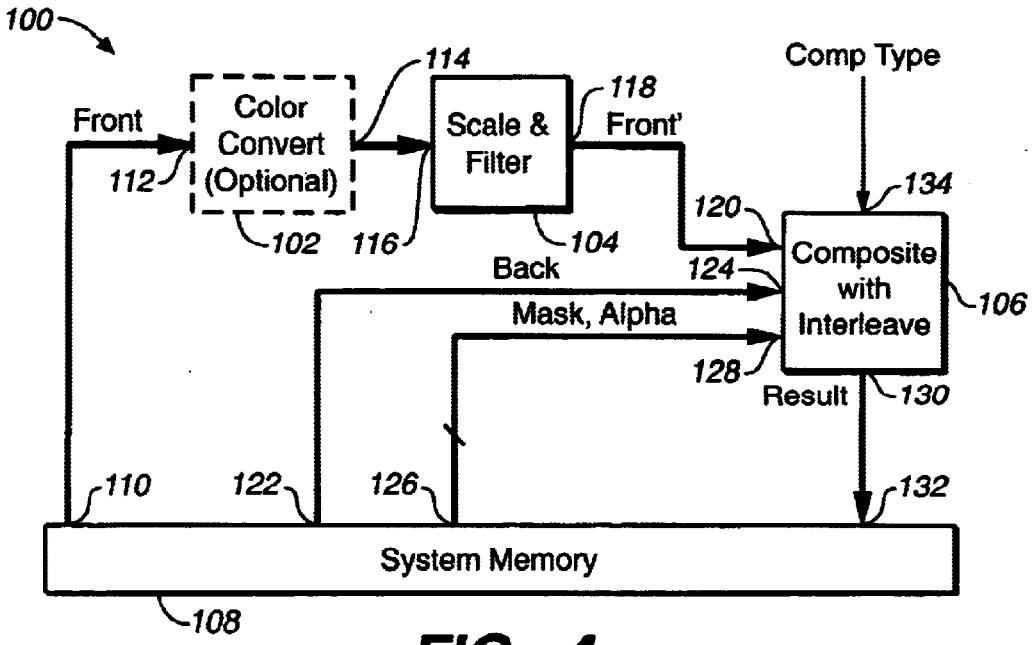
FIG. 4 is a block diagram of a preferred embodiment of the present invention.

Referring to FIG. 4, a block diagram of a circuit 100 is shown in accordance with a preferred embodiment of the present invention. The circuit 100 may implement a block modify and move engine (BMME) that may provide a generic framework for integrating video and graphics processing. The circuit 100 generally comprises a circuit 102, a circuit 104, a circuit 106 and a memory 108. The circuit 102 may be implemented as a color conversion circuit. In certain applications, the color conversion circuit 102 may be optional (to be discussed in connection with FIGS. 6, 7, 9 and 11). The circuit 104 may be implemented as a scale and filter circuit. The circuit 106 may be implemented as a composite with interleave circuit. The memory 108 may be implemented as a system memory. The circuit 100 may comprise a modified version of a typical composite section (e.g., the composite and interleave circuit 106) that may permit interleaving of Y and C component video data to a single graphics data stream. Additionally, the circuit 100 may allow other functional blocks to be included to provide unique features required by a particular application.

The memory 108 may have an output 110 that may present a signal (e.g., FRONT) to an input 112 of the color convert circuit 102. The circuit 102 may have an output 114 connected to an input 116 of the scale and filter circuit 104. The scale and filter circuit 104 may have an output 118 that may present a signal (e.g., FRONT') to an input 120 of the circuit 106. The system memory 108 may also have an output 122 that may present a signal (e.g., BACK) to an input 124 of the circuit 106 and an output 126 that may present a number of signals (e.g., MASK and ALPHA) to an input 128 of the circuit 106. The signals MASK and ALPHA may be presented together or individually. Additionally, each of the signals MASK and ALPHA may or may not be required for a particular implementation. The circuit 106 may have an output 130 that may present a signal (e.g., RESULT) to an input 132 of the system memory 108.

The composite with interleave circuit 106 may also have an input 134 that may receive a signal (e.g., COMPTYPE). The signal COMPTYPE may be externally generated and written to a BMME control register by a CPU (both of which are not shown). The signal COMPTYPE may control the type of data combination operation carried out by the composite and interleave block 106. The various signals of the present invention may be implemented as multi-bit or single bit signals or busses.

Figure 5:
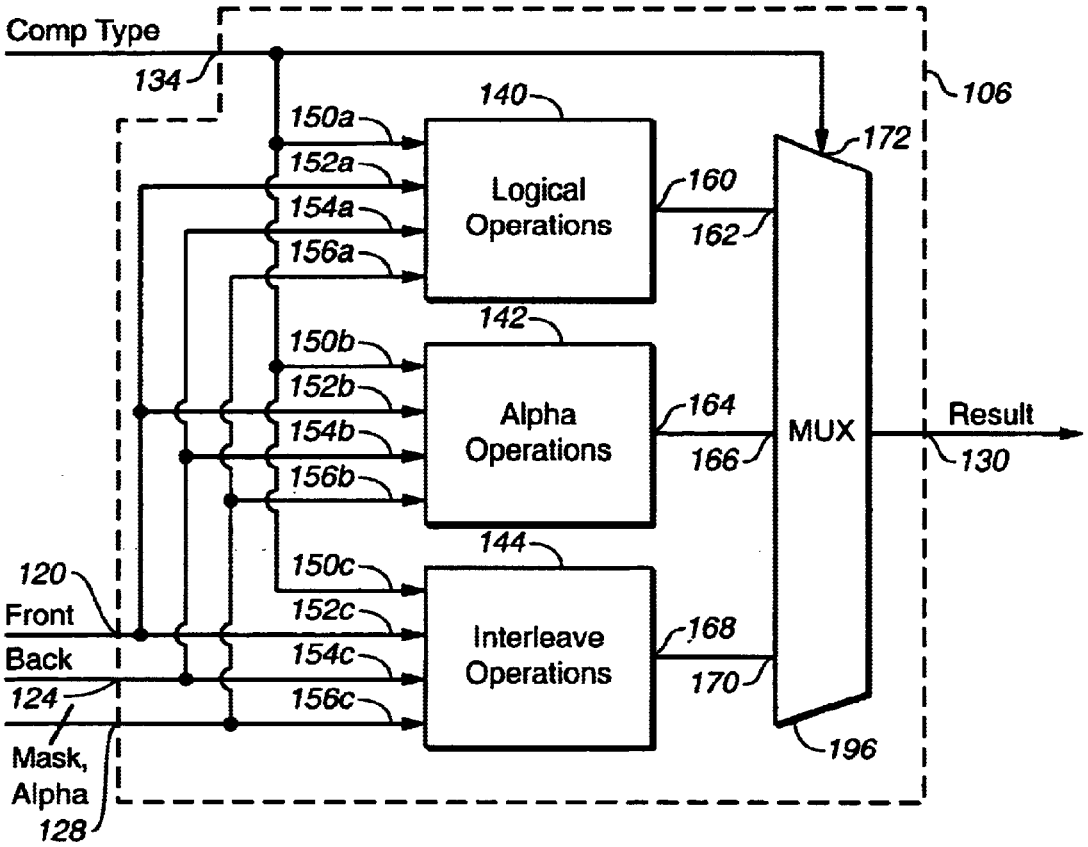
FIG. 5 is a detailed block diagram of a composite with interleave circuit of FIG. 4.

Referring to FIG. 5, a detailed block diagram of the composite with interleave circuit 106 is shown. The circuit 106 generally comprises a circuit 140, a circuit 142, a circuit 144 and a circuit 146. The circuit 140 may be implemented as a logical operations circuit (block). The circuit 142 may be implemented as an alpha operations circuit (block). The circuit 144 may be implemented as an interleave operations circuit (block). The circuit 146 may be implemented as a multiplexer.

The circuit 140 may have an input 150*a* that may receive the signal COMPTYPE, an input 152*a* that may receive the signal FRONT, an input 154*a* that may receive the signal BACK and an input 156*a* that may receive the signals MASK and ALPHA. Similarly, the circuits 142 and 144 may have, respectively, inputs 150*b* and 150*c* that may receive the signal COMPTYPE, inputs 152*b* and 152*c* that may receive the signal FRONT, inputs 154*b* and 154*c* that may receive the signal BACK and inputs 156*b* and 156*c* that may receive the signals MASK and ALPHA.

The circuit 140 may have an output 160 connected to an input 162 of the multiplexer 146. The circuit 142 may have an output 164 connected to an input 166 of the multiplexer 146. The circuit 144 may have an output 168 connected to an input 170 of the multiplexer 146. The multiplexer 146 may have an input 172 that may receive the signal COMPTYPE. The multiplexer 146 may present a signal received from the circuit 140, the circuit 142 or the circuit 144 as the signal RESULT in response to the signal COMPTYPE.

In a preferred embodiment of the present invention, a data modification section of the BMME 100 may comprise one or both of the circuits 102 and 104. For example, when conversion of video to graphics RGB is needed, the color conversion block 102 may be implemented. When the video format 4:4:4 is the only format used, the scale and filter block 104 may be omitted. A suitable design for the color conversion block 102 is described in co-pending application U.S. Ser. No. 09/878,594, filed Jun. 11, 2001, which is hereby incorporated by reference in its entirety. A suitable design for the scale and filter block 104 maybe described in co-pending application U.S. Ser. No. 09/960,572, filed Sep. 21, 2001 and/or Ser. No. 09/878,594, filed Jun. 11, 2001, which are hereby incorporated by reference in their entirety.

The logical operations block 140 of the composite with interleave block 106 may implement logical bitwise operations such as:

RESULT=FRONT XOR BACK

RESULT=(MASK AND FRONT) OR ((NOT MASK) AND BACK).

The alpha operations block 142 of the composite with interleave circuit 106 may perform alpha-blending equations such as:

RESULT=(ALPHA*FRONT)+((1-ALPHA)*BACK)).

The interleave operations block 144 of the composite with interleave circuit 106 generally comprises multiplexers and bit shifters (not shown). The interleave operations block 144 may perform (but is not limited to) the following operations:

(i) take data from the bus FRONT and pass the data unchanged to the bus RESULT, (the data may be chroma (U,V) pairs, or YUV, RGB, αYUV or αRGB pixels);

(ii) take chroma-only (U,V) data from the bus FRONT and Y data from the bus BACK and combine the data to make up 24-bpp YUV values on the bus RESULT; and/or (iii) take chroma-only (U,V) data from the bus FRONT, Y data from the bus BACK and alpha data from the bus ALPHA and combine the data to make up 32-bpp αYUV values on the bus RESULT.

Example operations of the interleave operations block 144 are shown in the following TABLES 1*a* and 1*b*.

TABLE 1a

| | Front | | | | Back | | | |
|---|---|---|---|---|---|---|---|---|
| Conversion | 31:24 | 23:16 | 15:8 | 7:0 | 31:24 | 23:16 | 15:8 | 7:0 |
| 4:2:0 to 4:4:4 | U | V | U | V | — | — | — | — |
| 4:2:2 to 4:4:4 | U | V | U | V | — | — | — | — |
| 4:4:4 to YUV | — | — | U | V | — | — | — | Y |
| 4:4:4 to RGB | — | R | G | B | — | — | — | — |
| 4:4:4 + alpha to αYUV | — | — | U | V | — | — | — | Y |
| αYUV to αRGB | A | R | G | B | — | — | — | — |

TABLE 1b

| | Mask/Alpha | | | | Result | | | |
|---|---|---|---|---|---|---|---|---|
| Conversion | 31:24 | 23:16 | 15:8 | 7:0 | 31:24 | 23:16 | 15:8 | 7:0 |
| 4:2:0 to 4:4:4 | — | — | — | — | U | V | U | V |
| 4:2:2 to 4:4:4 | — | — | — | — | U | V | U | V |
| 4:4:4 to YUV | — | — | — | — | — | Y | U | V |
| 4:4:4 to RGB | — | — | — | — | — | R | G | B |
| 4:4:4 + alpha to αYUV | — | — | — | A | A | Y | U | V |
| αYUV to αRGB | — | — | — | — | A | R | G | B |

The entries in the TABLE 1a and the TABLE 1b may relate to the conversion operations of the interleave circuit 144 of the composite with interleave circuit 106 (described in connection with FIGS. 6–11). Input and output busses (e.g., the bus FRONT, the bus BACK, the bus MASK/ALPHA and an output interleave bus RESULT) may be 32-bits wide. Any color or alpha component bus (e.g., RGB or alpha) may be 8-bits wide. However, other appropriate bit widths may be implemented to meet the criteria of a particular implementation. Additionally, some input bits may not be used in one or more conversion operations. Such unused bits may be omitted when applicable.

Figure 6:
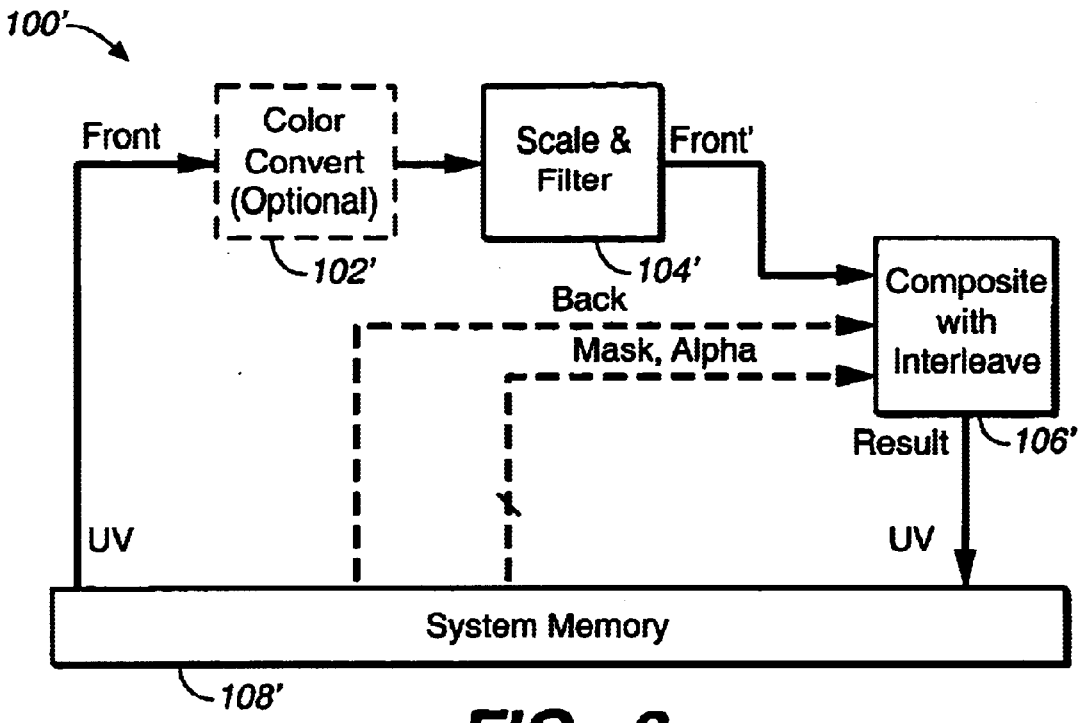
FIG. 6 is a block diagram illustrating an example operation of the present invention.

Referring to FIGS. 6–11, a variety of particular video data to graphics data conversion operations using circuits similar to the circuit 100 of FIG. 4. are shown. Referring to FIG. 6, a circuit 100' is shown illustrating a 4:2:0 to 4:4:4 conversion. The circuit 100' may be similar to the circuit 100. To achieve the necessary conversion steps for producing graphics format data from video, the BMME 100' may: (i) scale and filter in both the horizontal and vertical directions on chrominance data (the data may be required to be passed through the BMME 100' twice, once for each filtering direction), (ii) interpolate a complete set of new chrominance C values, since the existing 4:2:0 chrominance C sampling points are not aligned with the luminance Y points, (iii) alternately set the filter coefficients to 0.75:0.25 and 0.25:0.75, and (iv) pass the scaled and filtered U, V samples through the composite with interleave block 106' back to the bus RESULT unchanged. The color conversion circuit 102' may not be used.

The BMME 100' (e.g., video 4:2:0 to graphics 4:4:4 conversion) configuration may also be implemented for conversion of video 4:2:2 to graphics 4:4:4. However, a single scaling and filtering operation of chrominance C data may be performed in the horizontal direction only and the filter coefficients may be set to alternate between 1:0 and 0.5:0.5 in order to interpolate a new chrominance U,V pair between each existing U, V sample. The color conversion circuit 102' is generally not used.

Figure 7:
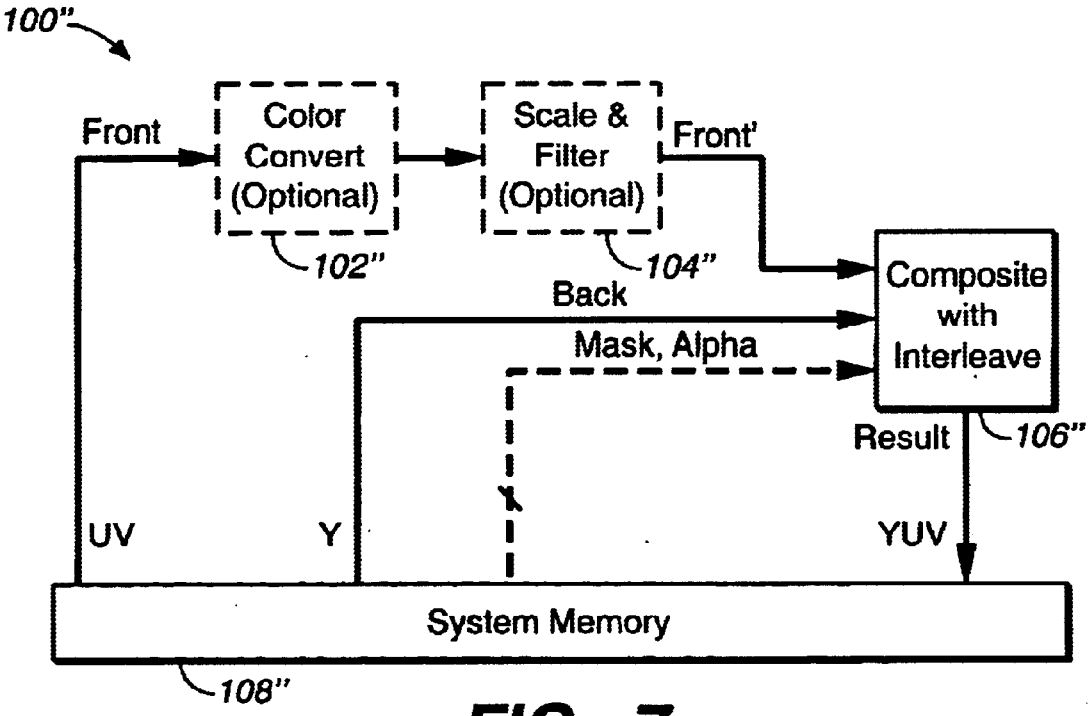
FIG. 7 is a block diagram illustrating an example operation of the present invention.

Referring to FIG. 7, a circuit 100" is shown illustrating a graphics 4:4:4 to graphics YUV conversion. The circuit 100" may be similar to the circuit 100. Interleaving of data may be performed to combine the separate Y and C data blocks into 24-bpp YUV pixels. The chrominance U, V values are generally input on the bus FRONT and the luminance Y value may be input on the bus BACK. The composite with interleave block 106" may be set (configured) to perform the interleaving operation such that the YUV pixels are placed on the bus RESULT. The color conversion circuit 102 and the scaling and filter circuit 104 are generally not used.

Figure 8:
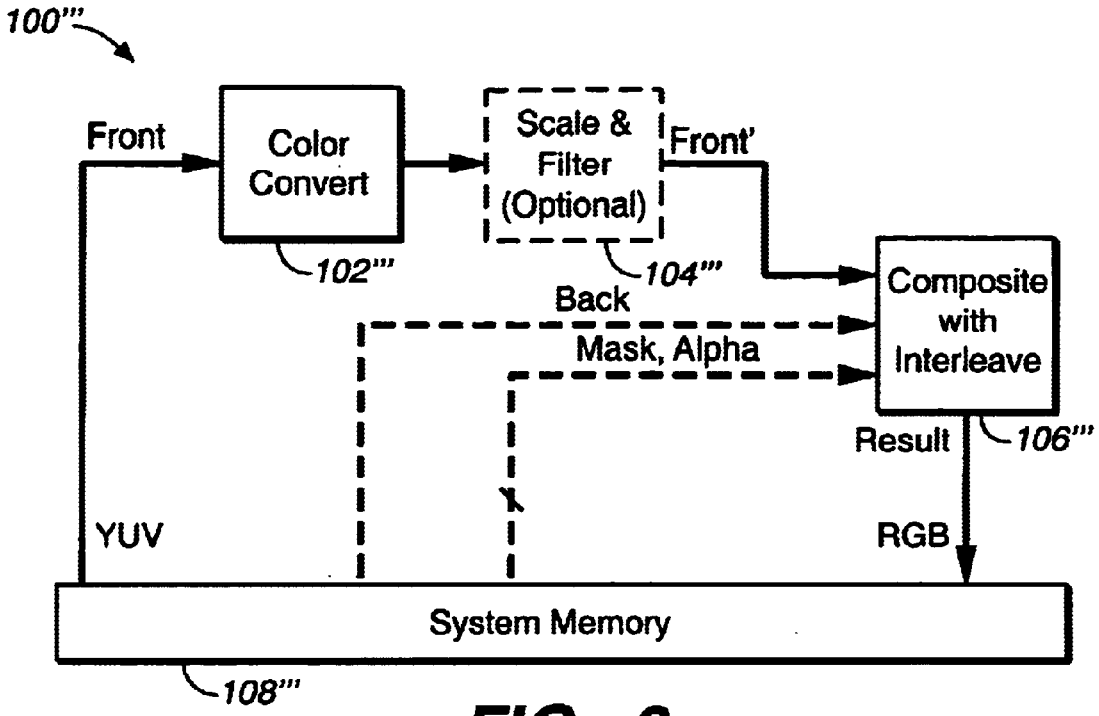
FIG. 8 is a block diagram illustrating an example operation of the present invention.

Referring to FIG. 8, a circuit 100'" is shown illustrating a graphics 4:4:4 to graphics RGB conversion. The circuit 100'" may be similar to the circuit 100. For conversion of graphics 4:4:4 to graphics RGB, a first step may be similar to the graphics 4:4:4 to graphics YUV conversion. A second step may be a color conversion process, where the YUV data on the bus FRONT may be converted to RGB format and passed directly to the bus RESULT.

Figure 9:
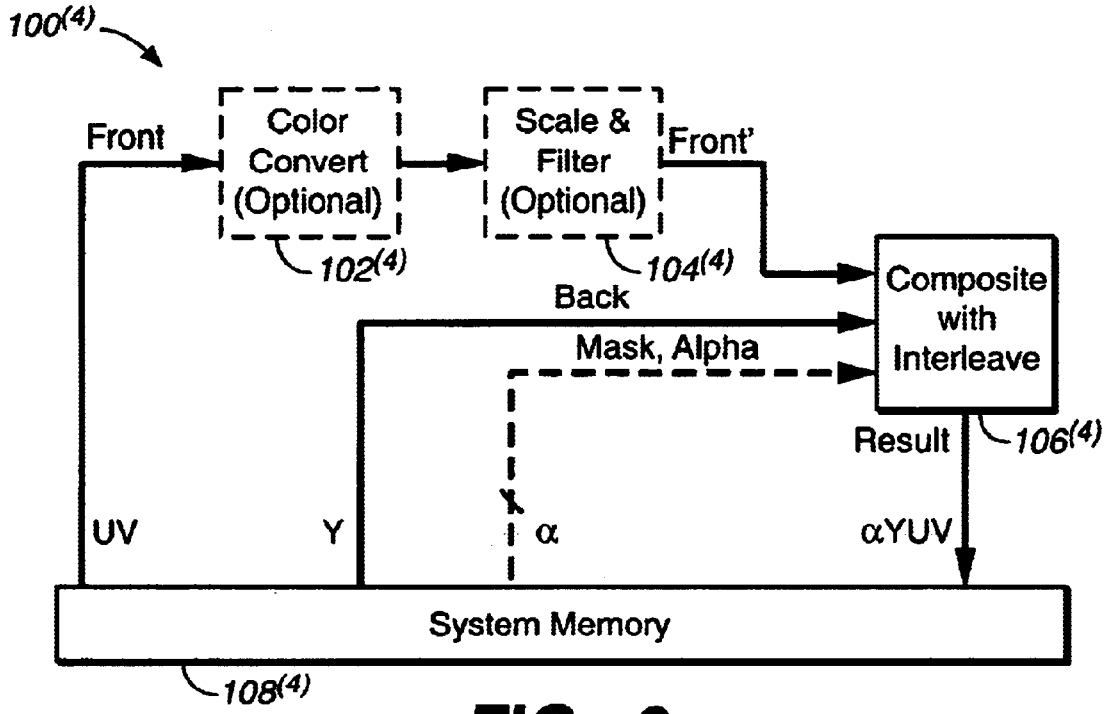
FIG. 9 is a block diagram illustrating an example operation of the present invention.

Referring to FIG. 9, a circuit $\mathbf{100}^{(4)}$ is shown illustrating a graphics 4:4:4 and alpha to graphics αYUV conversion. The circuit $\mathbf{100}^{(4)}$ may be implemented similarly to the circuit 100.

Figure 10:
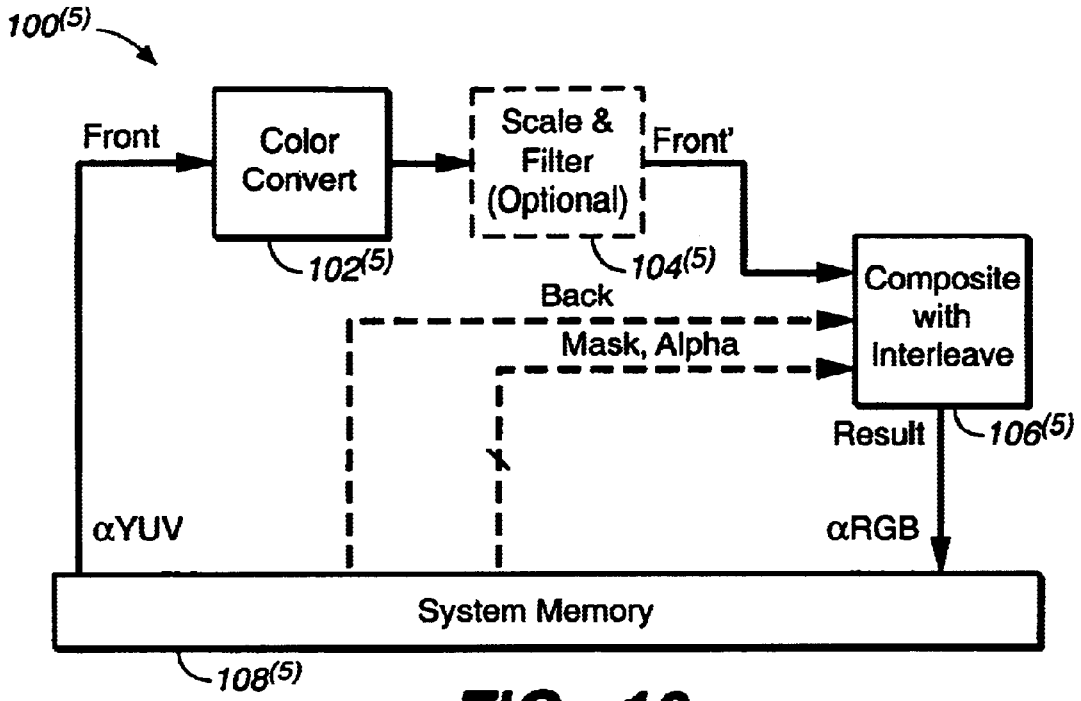
FIG. 10 is a block diagram illustrating an example operation of the present invention.

Referring to FIG. 10, a circuit $\mathbf{100}^{(5)}$ is shown illustrating a graphics αYUV to graphics αRGB conversion. The circuit $\mathbf{100}^{(5)}$ may be similar to the circuit 100. The present invention may also include alpha components. The circuit $\mathbf{100}^{(4)}$ or the circuit $\mathbf{100}^{(5)}$ may include any interleaving and/or color conversion process of an alpha channel value.

Figure 11:
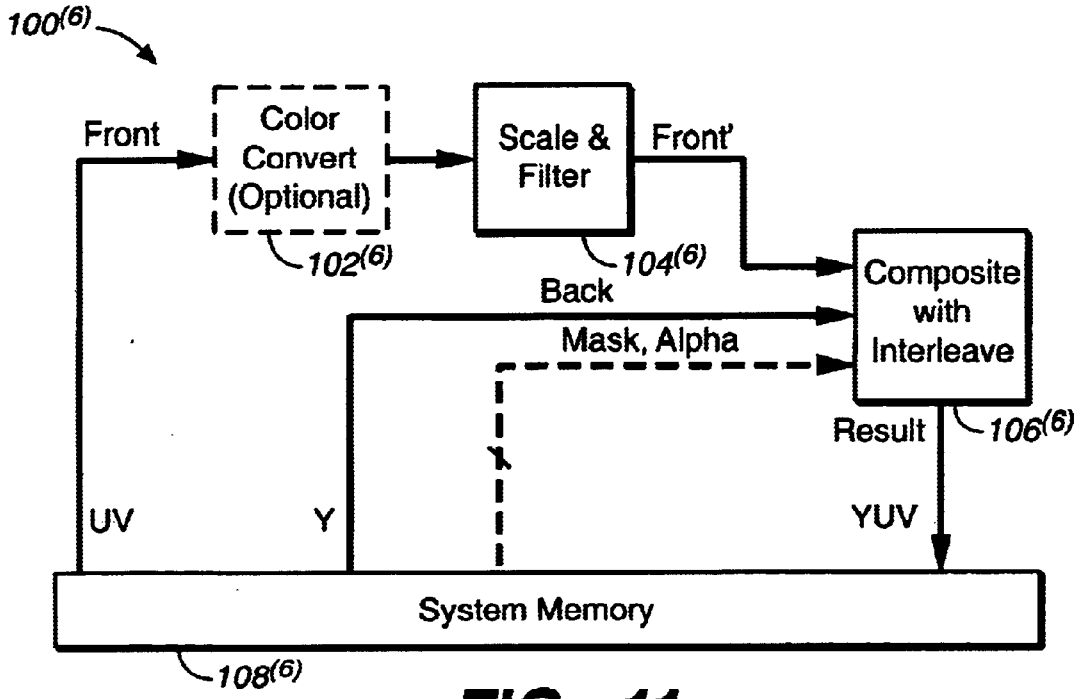
FIG. 11 is a block diagram illustrating an example operation of the present invention.

Referring to FIG. 11, a circuit $\mathbf{100}^{(6)}$ is shown illustrating a 4:2:2 to graphics YUV conversion. The circuit $\mathbf{100}^{(6)}$ may be similar to the circuit 100. The circuit $\mathbf{100}^{(6)}$ may combine filtering and interleaving within a single circuit. The circuit $\mathbf{100}^{(6)}$ may reduce the 4:2:2 to graphics YUV operation to a single pass of data through the BMME $\mathbf{100}^{(6)}$. Such a configuration may provide a savings in processing time and system bus usage. In the case of 4:2:0 to graphics YUV, the second filtering pass may be combined with the interleaving operation.

The present invention may provide a video sampling structure conversion engine that may permit interleaving of luminance and chrominance video data into a single video data stream. The single video data stream may be easily converted to a graphics data format.

While the invention has been particularly shown and described with reference to the preferred embodiments thereof, it will be understood by those skilled in the art that various changes in form and details may be made without departing from the spirit and scope of the invention.

What is claimed is:

1. An apparatus comprising:

a memory connected to a first input bus, a second input bus and an output bus;

a converter circuit configured to generate a first intermediate signal in response to converting a color format for a first data stream received on said first input bus;

a scale and filter circuit configured to generate a second intermediate signal by scaling and filtering said first intermediate signal; and a composite circuit configured to generate an output graphics stream on said output bus by interleaving said second intermediate signal and a second data stream received on said second input bus.

2. The apparatus according to claim 1, wherein said apparatus comprises a block modify and move engine (BMME) configured to modify a plurality of blocks from said first data stream while moving said blocks from one location to another location in said memory.

3. The apparatus according to claim 1, wherein said apparatus comprises a video sampling conversion block modify and move engine.

4. The apparatus according to claim 1, wherein said apparatus is configured to permit conversion between video data and graphics data.

5. The apparatus according to claim 1, wherein said composite circuit comprises:

a logical operations circuit configured to perform logical bitwise operations on said first data stream and said second data stream;

a alpha operations circuit configured to perform alpha-blending between said first data stream and said second data stream; and an interleave operations circuit configured to perform one or more predetermined interleave operations using said first data stream.

6. The apparatus according to claim 5, wherein said one or more predetermined interleave operations are selected from the group consisting of (i) receive data from said first input bus and pass said data unchanged to said output bus, (ii) receive chrominance data from said first input bus and luminance data from said second input bus and combine said chrominance and said luminance data to form a first particular output value on said output bus, and (iii) receive said chrominance data from said first input bus, said luminance data from said second input bus and alpha data from a third input bus and combine said chrominance, said luminance and said alpha data to form a second predetermined value on said output bus.

7. The apparatus according to claim 1, further comprising:

a memory configured to interface to said composite circuit via a third input bus.

8. The apparatus according to claim 1, wherein said apparatus is configured to perform conversion of one or more video data formats to graphics data.

9. The apparatus according to claim 1, further comprising a third input bus disposed between said memory and said composite circuit to carry a mask signal to control masking of said first data stream.

10. The apparatus according to claim 1, further comprising a third input bus disposed between said memory and said composite circuit to carry an alpha signal to control an alpha-blending of said first data stream with said second data stream.

11. The apparatus according to claim 5, wherein said composite circuit is further configured to select one of said logical operations circuit, said alpha circuit and said interleave operations circuit to generate said output graphics stream in response to a command signal.

12. An apparatus comprising:

means for generating a first intermediate signal by modifying a color format for a first data steam received from a memory;

means for generating a second intermediate signal by scaling and filtering said first intermediate signal;

means for interleaving said second intermediate signal and a second data stream received from said memory to generate an output graphics stream; and means for storing said output graphics stream in said memory.

13. A method for permitting conversion between video data and graphics data, comprising the steps of:

(A) generating a first intermediate signal by modifying a color format for a first data steam received from a memory;

(B) generating a second intermediate signal by scaling and filtering said first intermediate signal;

(C) interleaving said second intermediate signal and a second data stream received from said memory to generate an output graphics stream and;

(D) storing said output graphics stream in said memory.

14. The method according to claim 13; wherein step (C) comprises the sub-steps of:

(C-1) performing logical bitwise operations on said first data stream and said second data stream;

(C-2) performing alpha-blending between said first data stream and said second data stream; and (C-3) performing one or more predetermined interleave operations using said first data stream.

15. The method according to claim 14, wherein sub-step (C-3) comprises one or more of the following steps:

(i) receiving data from a first input bus and passing said data unchanged to an output bus;

(ii) receiving chrominance data from said first input bus and luminance data from a second input bus and combining said chrominance and said luminance data to form a first particular output value on said output bus; and (iii) receiving said chrominance data from said first input bus, said luminance data from said second input bus and alpha data from a third input bus and combining said chrominance, said luminance and said alpha data to form a second predetermined value on said output bus.

16. The method according to claim 15, further comprising the step of:

interfacing said memory with said first input bus and said output bus.

17. The method according to claim 13, further comprising the step of:

converting one or more video data formats in said first data stream to graphics data in said output graphics stream.

18. The method according to claim 13, wherein step (B) comprises the sub-step of filtering said first data stream in a first direction and said method further comprises the step of:

filtering said output graphics stream in a second direction.

19. The method according to claim 13, wherein step (C) comprises the sub-step of:

generating said output graphics stream by performing an exclusive OR operation between said first data stream and said second data stream.

20. The method according to claim 13, wherein step (C) comprises the sub-step of:

generating said output graphics stream by performing a masking operation on said first data stream and said second data stream.

* * * * *